US010605244B2

(12) United States Patent
Nouyrigat et al.

(10) Patent No.: US 10,605,244 B2
(45) Date of Patent: Mar. 31, 2020

(54) SCROLL COMPRESSOR PROVIDED WITH AN ORBITING GUIDING PORTION FOR IMPROVING THE FILLING OF THE COMPRESSION CHAMBERS

(71) Applicant: DANFOSS COMMERCIAL COMPRESSORS S.A., Trevoux (FR)

(72) Inventors: Nicolas Nouyrigat, Lyons (FR); Patrice Bonnefoi, Saint Didier au Mont d'or (FR); Yves Rosson, Villars les Dombes (FR); Ingrid Claudin, Villars les Dombes (FR); Arnaud Daussin, Saint Germain Au Mont d'or (FR)

(73) Assignee: Danfoss Commercial Compressors S.A., Trevoux (FR)

( * ) Notice: Subject to any disclaimer, the term of this patent is extended or adjusted under 35 U.S.C. 154(b) by 274 days.

(21) Appl. No.: 15/521,635

(22) PCT Filed: Sep. 8, 2015

(86) PCT No.: PCT/EP2015/070466
§ 371 (c)(1),
(2) Date: Apr. 25, 2017

(87) PCT Pub. No.: WO2016/066311
PCT Pub. Date: May 6, 2016

(65) Prior Publication Data

US 2017/0241420 A1 Aug. 24, 2017

(30) Foreign Application Priority Data

Oct. 27, 2014 (FR) ..... 14 60313

(51) Int. Cl.
*F01C 1/02* (2006.01)
*F04C 18/02* (2006.01)
(Continued)

(52) U.S. Cl.
CPC ..... *F04C 29/12* (2013.01); *F04C 18/0215* (2013.01); *F04C 18/0223* (2013.01); *F04C 27/001* (2013.01)

(58) Field of Classification Search
CPC .. F04C 29/12; F04C 18/0246; F04C 18/0215; F04C 27/001; F04C 18/0269; F01C 1/0246
See application file for complete search history.

(56) References Cited

U.S. PATENT DOCUMENTS 3,989,422 A * 11/1976 Guttinger ..... F01C 1/0223 418/55.1
3,030,192 A 2/2000 Hill et al.
(Continued)

FOREIGN PATENT DOCUMENTS

CN 1201116 A 12/1998
CN 1438425 A 8/2003
(Continued)

OTHER PUBLICATIONS

English translation of JP03096679 by Japan Platform for Patent Information Dec. 6, 2018.*
(Continued)

*Primary Examiner* — Deming Wan
(74) *Attorney, Agent, or Firm* — McCormick, Paulding & Huber PLLC

(57) ABSTRACT

This scroll compressor includes a scroll compression unit including a first fixed scroll including a first fixed base plate and a first fixed spiral wrap, an orbiting scroll arrangement (7) including a first orbiting spiral wrap (14), the first fixed spiral wrap and the first orbiting spiral wrap (14) forming a plurality of first compression chambers. The scroll compressor further includes a refrigerant suction part suitable for supplying the scroll compression unit with refrigerant to be compressed. The orbiting scroll arrangement (7) further
(Continued)

includes a first orbiting guiding portion (21) extending from an outer end portion of the first orbiting spiral wrap (14) and configured to guide, in use, at least a part of the refrigerant supplied to the scroll compression unit towards the first compression chambers.

21 Claims, 6 Drawing Sheets

(51) Int. Cl.
*F04C 29/12* (2006.01)
*F04C 27/00* (2006.01)

(56) References Cited

U.S. PATENT DOCUMENTS

| | | | | |
|---|---|---|---|---|
| 6,050,792 | A | 4/2000 | Shaffer | |
| 6,116,875 | A * | 9/2000 | Kolb | F01C 1/0223 418/55.2 |
| 6,174,150 | B1 | 1/2001 | Tsubono et al. | |
| 6,364,643 | B1 | 4/2002 | Milliff | |
| 7,614,860 | B2 * | 11/2009 | Yano | F04C 18/0223 418/210 |
| 2003/0150223 | A1 | 8/2003 | Tang et al. | |
| 2006/0104846 | A1 | 5/2006 | Hwang | |
| 2006/0222545 | A1 | 10/2006 | Nam et al. | |
| 2006/0222546 | A1 | 10/2006 | Lee et al. | |
| 2014/0154124 | A1 | 6/2014 | Doepker et al. | |

FOREIGN PATENT DOCUMENTS

| | | | | |
|---|---|---|---|---|
| CN | 1773118 | A | 5/2006 | |
| CN | 1840912 | A | 10/2006 | |
| CN | 1840913 | A | 10/2006 | |
| CN | 203321824 | U | 12/2013 | |
| EP | 1336759 | A2 | 8/2003 | |
| EP | 1657443 | A1 | 5/2006 | |
| GB | 2358438 | A | 7/2001 | |
| JP | 03096679 | A * | 4/1991 | F04C 18/0215 |
| JP | H07204985 | A | 8/1995 | |
| JP | H08-144972 | A | 6/1996 | |
| JP | 2698764 | B2 | 1/1998 | |
| JP | H10-288173 | A | 10/1998 | |
| JP | 2000205151 | A | 7/2000 | |
| JP | 2000249082 | A | 9/2000 | |
| JP | 2006249991 | A | 9/2006 | |
| JP | 2006283753 | A | 10/2006 | |
| JP | 2007100516 | A | 4/2007 | |
| JP | 4252659 | B2 | 4/2009 | |
| JP | 4540508 | B2 | 9/2010 | |
| JP | 4671830 | B2 | 4/2011 | |
| KR | 20030068404 | A | 8/2003 | |
| KR | 100575709 | B1 | 5/2006 | |
| KR | 20060104431 | A | 10/2006 | |

OTHER PUBLICATIONS

International Search Report for PCT U.S. Appl. No. PCT/EP2015/070466 dated Oct. 30, 2015.
Indian First Examination Report for corresponding India Application No. 201717013325 dated May 27, 2019.

* cited by examiner

SCROLL COMPRESSOR PROVIDED WITH AN ORBITING GUIDING PORTION FOR IMPROVING THE FILLING OF THE COMPRESSION CHAMBERS

CROSS-REFERENCE TO RELATED APPLICATIONS

This application is a National Stage application of International Patent Application No. PCT/EP2015/070466, filed on Sep. 8, 2015, which claims priority to French Patent Application No. 1460313, filed on Oct. 27, 2014, each of which is hereby incorporated by reference in its entirety.

TECHNICAL FIELD

The present invention relates to a scroll compressor, and in particular to a scroll refrigeration compressor.

BACKGROUND

As known, a scroll refrigeration compressor includes:

a closed container, a scroll compression unit disposed in the closed container and including at least:

a first fixed scroll including a first fixed base plate and a first fixed spiral wrap, an orbiting scroll arrangement including a first orbiting spiral wrap, the first fixed spiral wrap and the first orbiting spiral wrap forming a plurality of first compression chambers, a drive shaft adapted for driving the orbiting scroll arrangement in an orbital movement, an electric driving motor coupled to the drive shaft and arranged for driving in rotation the drive shaft about a rotation axis, and a refrigerant suction part suitable for supplying the scroll compression unit with refrigerant to be compressed.

Typically, the refrigerant suction part extends radially with respect to the orbiting scroll arrangement and emerges in an annular volume fluidly connected to a first external compression chamber.

Such a configuration of the refrigerant suction part induces significant pressure drops and an underfilling of the first compression chambers, which harm the efficiency of the scroll compression unit, and thus of the scroll compressor.

SUMMARY

It is an object of the present invention to provide an improved scroll compressor which can overcome the drawbacks encountered in conventional scroll compressors.

Another object of the present invention is to provide a scroll compressor which has an improved efficiency compared to the conventional scroll compressors.

According to the invention such a scroll compressor includes:

a scroll compression unit including at least:

a first fixed scroll including a first fixed base plate and a first fixed spiral wrap, an orbiting scroll arrangement including a first orbiting spiral wrap, the first fixed spiral wrap and the first orbiting spiral wrap forming a plurality of first compression chambers, the first orbiting spiral wrap including a plurality of sealing contact zones configured to cooperate with the first fixed spiral wrap during an orbital movement of the orbiting scroll arrangement, a refrigerant suction part suitable for supplying the scroll compression unit with refrigerant to be compressed, wherein the orbiting scroll arrangement further includes a first orbiting guiding portion extending from an outer end portion of the first orbiting spiral wrap and configured to guide, in use, at least a part of the refrigerant supplied to the scroll compression unit towards the first compression chambers, the first orbiting guiding portion being arranged upstream an outermost sealing contact zone belonging to said sealing contact zones with respect to a refrigerant flow direction.

In other words, the first orbiting guiding portion is arranged upstream the sealing contact zone, provided on the first orbiting spiral wrap, which is farthest from the center of the first orbiting spiral wrap.

Such a configuration of the orbiting scroll arrangement, and more particularly the presence of the first orbiting guiding portion upstream the first orbiting spiral wrap, induces an improvement of the filling of the first compression chambers, which lead to an increase of efficiency of the scroll compression unit, and thus of the scroll compressor.

According to an embodiment of the invention, the first orbiting guiding portion is configured to guide, in use, a first part of the refrigerant supplied to the scroll compression unit towards a first outermost compression chamber belonging to the first compression chambers and being delimited by an outer wall of the first orbiting spiral wrap and an inner wall of the first fixed spiral wrap, and a second part of the refrigerant supplied to the scroll compression unit towards a second outermost compression chamber belonging to the first compression chambers and being delimited by an outer wall of the first fixed spiral wrap and an inner wall of the first orbiting spiral wrap. According to an embodiment of the invention, the first orbiting guiding portion extends from said outermost sealing contact zone.

According to an embodiment of the invention, the first fixed scroll further includes a first fixed guiding portion extending from an outer end portion of the first fixed spiral wrap, the first fixed guiding portion partially delimiting a first refrigerant inlet passage in which extends the first orbiting guiding portion.

According to an embodiment of the invention, the first orbiting guiding portion is configured to, in use, separate the refrigerant supplied to the first refrigerant inlet passage into a first refrigerant part and a second refrigerant part, and guide the first and second refrigerant parts respectively towards the first and second outermost compression chambers.

According to an embodiment of the invention, the first fixed spiral wrap includes a plurality of sealing contact zones configured to cooperate with the first orbiting spiral wrap during an orbital movement of the orbiting scroll arrangement, the first fixed guiding portion extending from an outermost sealing contact zone belonging to said sealing contact zones provided on the first fixed spiral wrap.

According to an embodiment of the invention, the width of the first refrigerant inlet passage decreases in a refrigerant flow direction. This configuration of the first refrigerant inlet passage and the location of the first orbiting guiding portion therein ensure a separation of the refrigerant supplied to the first refrigerant inlet passage in a section of the first refrigerant inlet passage where the refrigerant velocity is low (compared to the refrigerant velocity at the outer ends of the first fixed and orbiting spiral wraps). This results in a reduction of the pressure drops upstream the first compression chambers, and thus improves the efficiency of the scroll compressor.

According to an embodiment of the invention, the width of the first refrigerant inlet passage decreases as far as the outermost sealing contact zone provided on the first fixed spiral wrap.

According to an embodiment of the invention, the first orbiting guiding portion extends in the continuity of the first orbiting spiral wrap.

According to an embodiment of the invention, the first orbiting guiding portion and the first orbiting spiral wrap have substantially a same height.

According to an embodiment of the invention, the first orbiting guiding portion is substantially straight.

According to an embodiment of the invention, the first orbiting guiding portion extends substantially tangentially with respect to the outer end portion of the first orbiting spiral wrap.

According to an embodiment of the invention, the first orbiting guiding portion extends substantially parallely to the refrigerant suction part.

According to an embodiment of the invention, the first orbiting guiding portion stands upright from an orbiting base plate.

According to an embodiment of the invention, the first orbiting guiding portion includes a nose portion oriented towards the refrigerant suction part.

According to an embodiment of the invention, the nose portion of the first orbiting guiding portion is configured to be located nearby the refrigerant suction part during at least a part of the orbital movement of the orbiting scroll arrangement.

According to an embodiment of the invention, the nose portion of the first orbiting guiding portion is symmetrical. The nose portion of the first orbiting guiding portion may be rounded, tapered or sharp. This configuration of the nose portion further improves the reduction of the pressure drops upstream the first compression chambers, and thus the efficiency of the scroll compressor.

According to an embodiment of the invention, the refrigerant suction part is oriented towards the first refrigerant inlet passage and is configured to conduct, in use, at least a part of the refrigerant suctioned in the refrigerant suction part towards the first refrigerant inlet passage.

According to an embodiment of the invention, the refrigerant suction part includes a refrigerant supplying aperture facing the first refrigerant inlet passage.

According to an embodiment of the invention, the refrigerant supplying aperture emerges nearby or in the first refrigerant inlet passage.

According to an embodiment of the invention, the first refrigerant inlet passage extends along a first passage direction and the refrigerant suction part extends along a supplying direction, the supplying direction being angled with respect to the passage direction at an angle between −15 and +15 degrees.

In other words, the refrigerant suction part extends substantially parallel to the extension direction of the first refrigerant inlet passage.

According to an embodiment of the invention, the refrigerant suction part extends substantially tangentially with respect to an inner wall of the outer end portion of the first fixed spiral wrap.

According to an embodiment of the invention, the refrigerant suction part is formed by a refrigerant suction element sealingly connected to the scroll compression unit. Therefore, the refrigerant enters the scroll compression unit without cooling down beforehand the driving motor and thus without being heated by the driving motor, which improves the scroll compression unit efficiency.

According to an embodiment of the invention, the refrigerant suction element includes a notch suitable for receiving a portion of an orbiting base plate of the orbiting scroll arrangement during at least a part of the orbital movement of the orbiting scroll arrangement. The notch may for example be provided on an end portion of the refrigerant suction element oriented towards the first orbiting guiding portion.

According to an embodiment of the invention, the scroll compression unit further includes a second fixed scroll including a second fixed base plate and a second fixed spiral wrap, the first and second fixed scrolls defining an inner volume, and the orbiting scroll arrangement is disposed in the inner volume and further includes a second orbiting spiral wrap, the second fixed spiral wrap and the second orbiting spiral wrap forming a plurality of second compression chambers.

According to an embodiment of the invention, the orbiting scroll arrangement further includes a second orbiting guiding portion extending from an outer end portion of the second orbiting spiral wrap and configured to guide, in use, at least a part of the refrigerant supplied to the scroll compression unit towards the second compression chambers.

According to an embodiment of the invention, the second orbiting spiral wrap includes a plurality of sealing contact zones configured to cooperate with the second fixed spiral wrap during an orbital movement of the orbiting scroll arrangement, the second orbiting guiding portion extending from an outermost sealing contact zone belonging to said sealing contact zones.

According to an embodiment of the invention, the second fixed scroll further includes a second fixed guiding portion extending from an outer end portion of the second fixed spiral wrap, the second fixed guiding portion partially delimiting a second refrigerant inlet passage in which extends the second orbiting guiding portion.

According to an embodiment of the invention, the second fixed spiral wrap includes a plurality of sealing contact zones configured to cooperate with the second orbiting spiral wrap during an orbital movement of the orbiting scroll arrangement, the second fixed guiding portion extending from an outermost sealing contact zone belonging to said sealing contact zones provided on the second fixed spiral wrap.

According to an embodiment of the invention, the width of the second refrigerant inlet passage decreases in a refrigerant flow direction. According to an embodiment of the invention, the width of the second refrigerant inlet passage decreases as far as the outermost sealing contact zone provided on the second fixed spiral wrap.

According to an embodiment of the invention, the second orbiting guiding portion extends in the continuity of the second orbiting spiral wrap.

According to an embodiment of the invention, the second orbiting guiding portion and the second orbiting spiral wrap have substantially a same height.

According to an embodiment of the invention, the second orbiting guiding portion is substantially straight.

According to an embodiment of the invention, the second orbiting guiding portion extends substantially tangentially with respect to the outer end portion of the second orbiting spiral wrap.

According to an embodiment of the invention, the second orbiting guiding portion extends substantially parallely to the refrigerant suction part.

According to an embodiment of the invention, the second orbiting guiding portion includes a nose portion oriented towards the refrigerant suction part.

According to an embodiment of the invention, the nose portion of the second orbiting guiding portion is configured to be located nearby the refrigerant suction part during at least a part of the orbital movement of the orbiting scroll arrangement.

According to an embodiment of the invention, the nose portion of the second orbiting guiding portion is symmetrical. The nose portion of the second orbiting guiding portion may be rounded, tapered or sharp.

According to an embodiment of the invention, the refrigerant suction part is oriented towards the second refrigerant inlet passage and is configured to conduct, in use, at least a part of the refrigerant suctioned in the refrigerant suction part towards the second refrigerant inlet passage.

According to an embodiment of the invention, the refrigerant supplying aperture faces the second refrigerant inlet passage.

According to an embodiment of the invention, the refrigerant supplying aperture emerges nearby or in the second refrigerant inlet passage.

According to an embodiment of the invention, the second refrigerant inlet passage extends along a second passage direction, the supplying direction being angled with respect to the second passage direction at an angle between −15 and +15 degrees. In other words, the refrigerant suction part extends substantially parallel to the extension direction of the second refrigerant inlet passage.

According to an embodiment of the invention, the refrigerant suction part extends substantially tangentially with respect to an inner wall of the outer end portion of the second fixed spiral wrap.

According to an embodiment of the invention, the refrigerant suction part is configured to conduct, in use, substantially a same amount of refrigerant in the first and second refrigerant inlet passages.

According to an embodiment of the invention, the refrigerant suction part is provided with a deflector member configured to deflect at least a first part of the refrigerant suctioned in the refrigerant suction part towards the first compression chambers.

According to an embodiment of the invention, the deflector member is configured to deflect at least a first part of the refrigerant suctioned in the refrigerant suction part towards the first refrigerant inlet passage and a second part of the refrigerant suctioned in the refrigerant suction part towards the second refrigerant inlet passage.

The deflector member may for example have a triangular cross section. The deflector member is advantageously located inside the refrigerant suction part, and preferably secured to the refrigerant suction part.

According to an embodiment of the invention, the first fixed spiral wrap defines a first spiral path fluidly connected to the first refrigerant inlet passage.

According to an embodiment of the invention, the second fixed spiral wrap defines a second spiral path fluidly connected to the second refrigerant inlet passage.

According to an embodiment of the invention, the first refrigerant inlet passage is shaped such that the refrigerant suction part can be smoothly connected to the first spiral path. This provision leads to reduce as much as possible the pressure drops.

According to an embodiment of the invention, the height of the first refrigerant inlet passage increases in the refrigerant flow direction, i.e. from the refrigerant suction part.

According to an embodiment of the invention, the second refrigerant inlet passage is shaped such that the refrigerant suction part can be smoothly connected to the second spiral path. This provision leads to reduce as much as possible the pressure drops.

According to an embodiment of the invention, the height of the second refrigerant inlet passage increases in the refrigerant flow direction, i.e. from the refrigerant suction part.

According to an embodiment of the invention, the first refrigerant inlet passage is partially delimited by the first fixed base plate and the orbiting base plate of the orbiting scroll arrangement.

According to an embodiment of the invention, the second refrigerant inlet passage is partially delimited by the second fixed base plate and the orbiting base plate of the orbiting scroll arrangement.

According to an embodiment of the invention, the first and second refrigerant inlet passages are located one above the other.

According to an embodiment of the invention, the scroll compressor further includes a drive shaft adapted for driving the orbiting scroll arrangement in an orbital movement, According to an embodiment of the invention, the drive shaft extends across the orbiting scroll arrangement and further includes a first guided portion and second guided portion located on either side of a driving portion adapted for driving the orbiting scroll arrangement in an orbital movement, the scroll compressor further including guide elements for guiding in rotation the drive shaft, the guide elements comprising at least one first guide bearing and at least one second guide bearing located on either side of the orbiting scroll arrangement and arranged to respectively guide the first and second guided portions of the drive shaft.

According to an embodiment of the invention, the scroll compressor is a vertical scroll compressor and the drive shaft extends substantially vertically. The driving motor may be located above the scroll compression unit.

According to an embodiment of the invention, the first and second orbiting spiral wraps are respectively provided on first and second faces of a common base plate, the second face being opposite to the first face.

According to an embodiment of the invention, the scroll compressor further includes an electric driving motor coupled to the drive shaft and arranged for driving in rotation the drive shaft about a rotation axis.

According to an embodiment of the invention, the scroll compressor further include a closed container in which is disposed the scroll compression unit.

According to an embodiment of the invention, the closed container defines a high pressure discharge volume containing the driving motor. Advantageously, the refrigerant suction part is fluidly isolated from the high pressure discharge volume. The scroll compression unit may also be contained in the high pressure discharge volume.

According to an embodiment of the invention, the scroll compressor is a variable-speed scroll compressor.

According to an embodiment of the invention, the first and second fixed scrolls are fixed in relation to the closed container.

The present invention also relates to an orbiting scroll arrangement for a scroll compressor, the orbiting scroll arrangement including:

a first orbiting spiral wrap designed to partially form a plurality of first compression chambers, the first orbiting spiral wrap including a plurality of sealing contact zones, and a first orbiting guiding portion extending from an outer end portion of the first orbiting spiral wrap and configured to guide, in use, refrigerant towards the first compression chambers, the first orbiting guiding portion being located upstream an outermost sealing contact zone belonging to said sealing contact zones with respect to a refrigerant flow direction.

These and other advantages will become apparent upon reading the following description in view of the drawing attached hereto representing, as non-limiting example, an embodiment of a scroll compressor according to the invention.

BRIEF DESCRIPTION OF THE DRAWINGS

The following detailed description of one embodiment of the invention is better understood when read in conjunction with the appended drawings being understood, however, that the invention is not limited to the specific embodiment disclosed.

DETAILED DESCRIPTION

Figure 1:
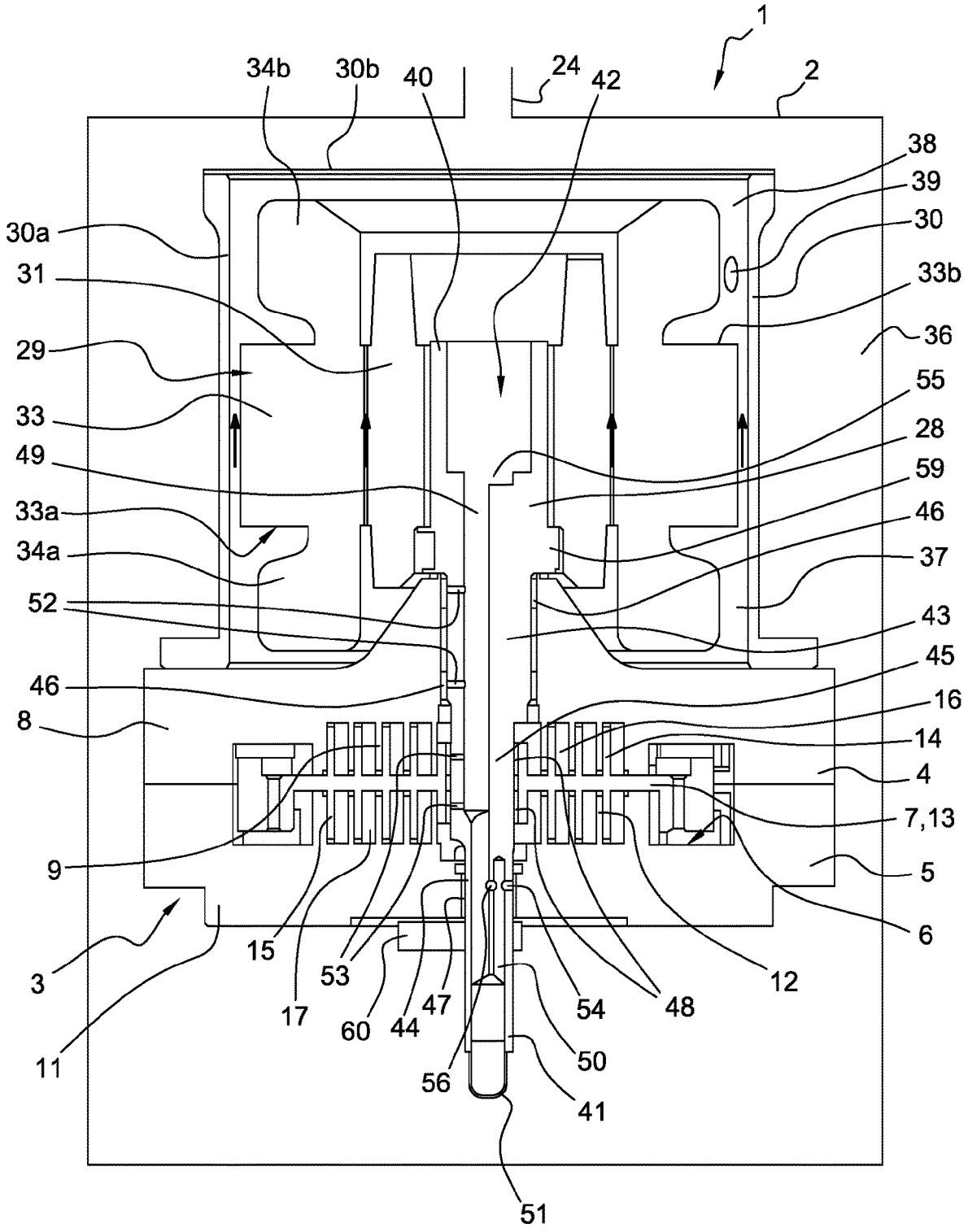
FIGS. 1 and 2 are longitudinal section views of a scroll compressor according to the invention.
Figure 2:
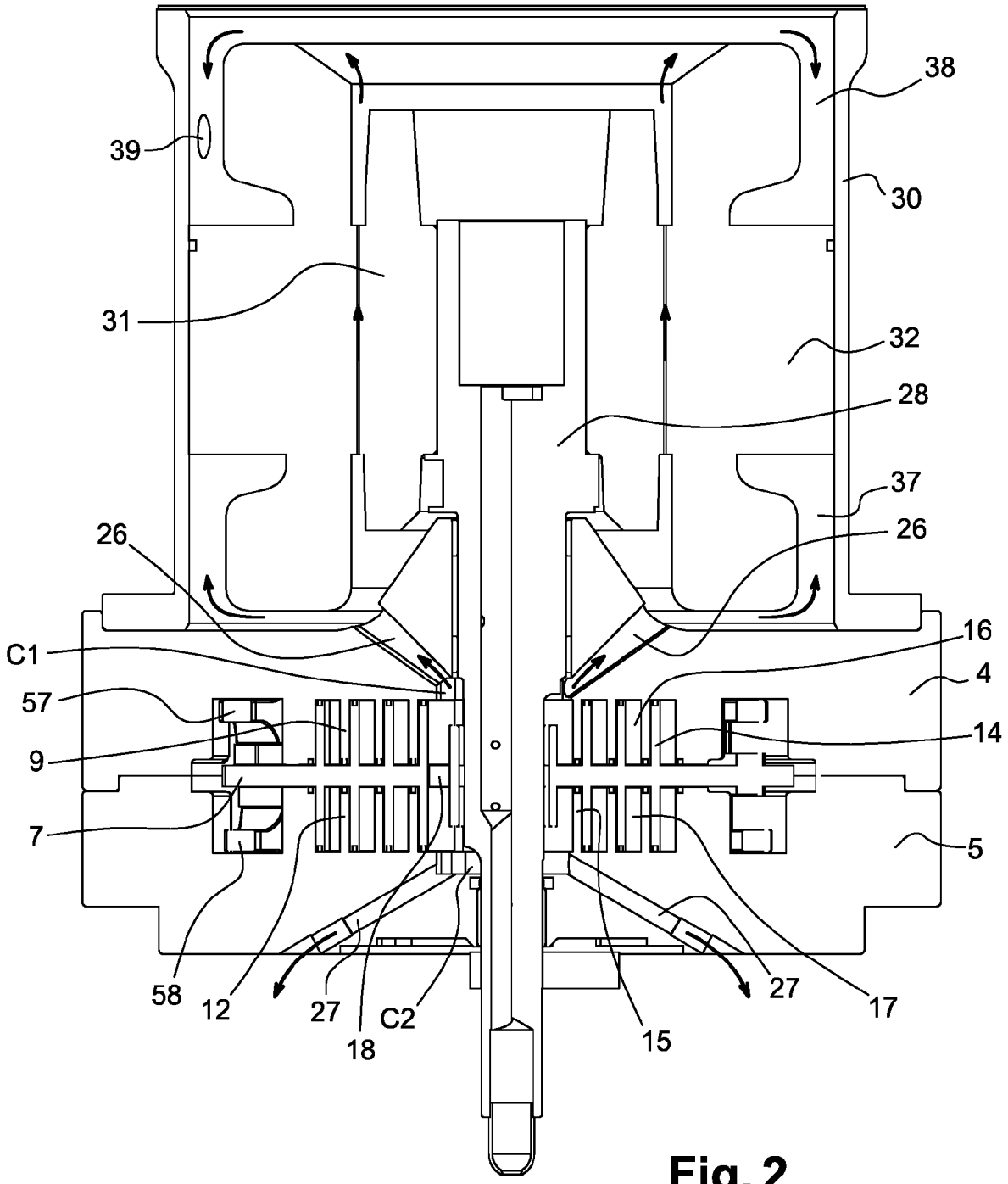
Figure 3:
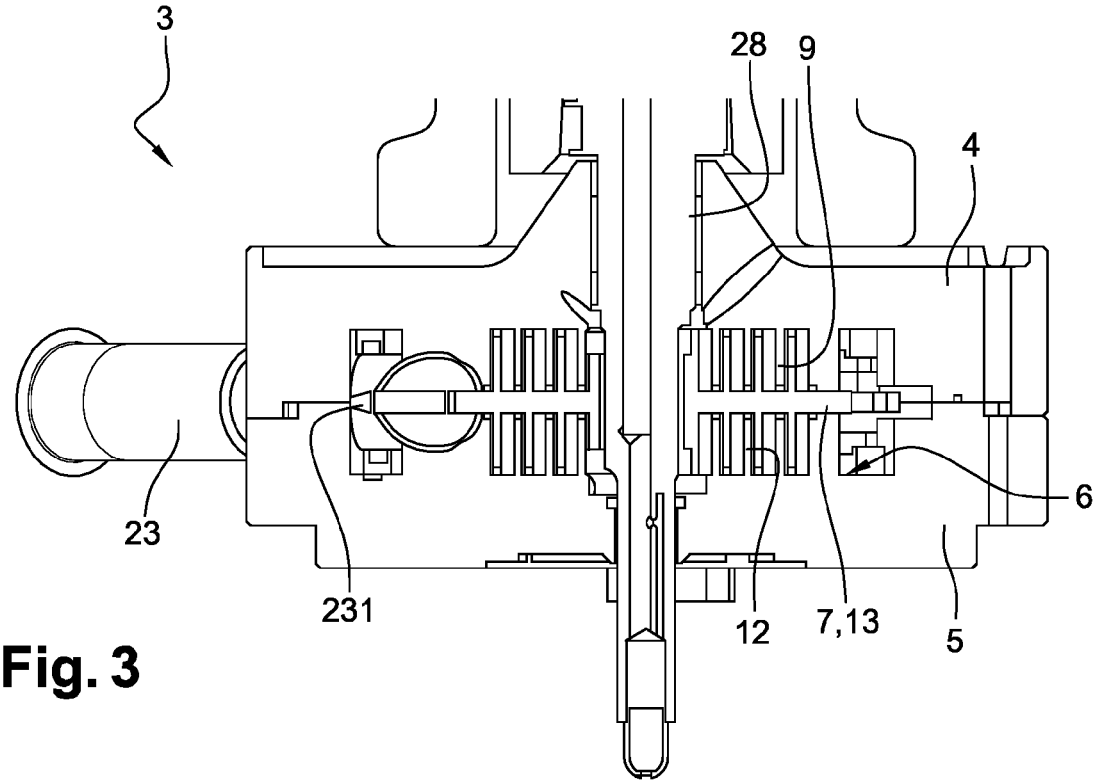
FIGS. 3 and 4 are partial longitudinal section views of the scroll compressor of FIG. 1.

FIG. 1 shows a vertical scroll compressor 1 including a closed container 2 defining a high pressure discharge volume, and a scroll compression unit 3 disposed inside the closed container 2.

The scroll compression unit 3 includes first and second fixed scrolls 4, 5 defining an annular inner volume 6. In particular the first and second fixed scrolls 4, 5 are fixed in relation to the closed container 2. The first fixed scroll 4 may for example be secured to the second fixed scroll 5. The scroll compression unit 3 further includes an orbiting scroll arrangement 7 disposed in the inner volume 6.

The first fixed scroll 4 includes a base plate 8 and a spiral wrap 9 projecting from the base plate 8 towards the second fixed scroll 5, and the second fixed scroll 5 includes a base plate 11 and a spiral wrap 12 projecting from the base plate 11 towards the first fixed scroll 4.

The orbiting scroll arrangement 7 includes a base plate 13, a first spiral wrap 14 projecting from a first face of the base plate 13 towards the first fixed scroll 4, and a second spiral wrap 15 projecting from a second face of the base plate 13 towards the second fixed scroll 5, the second face being opposite to the first face such that the first and second spiral wraps 14, 15 project in opposite directions. The first and second fixed scrolls 4, 5 are respectively located above and below the orbiting scroll arrangement 7.

The first spiral wrap 14 of the orbiting scroll arrangement 7 meshes with the spiral wrap 9 of the first fixed scroll 4 to form a plurality of compression chambers 16 between them, and the second spiral wrap 15 of the orbiting scroll arrangement 7 meshes with the spiral wrap 12 of the second fixed scroll 5 to form a plurality of compression chambers 17 between them. Each of the compression chambers 16, 17 has a variable volume which decreases from the outside towards the inside, when the orbiting scroll arrangement 7 is driven to orbit relative to the first and second fixed scrolls 4, 5.

The orbiting scroll arrangement 7 includes at least one communicating hole 18 arranged to fluidly connect the central compression chamber 16 and the central compression chamber 17. The communicating hole 18 may for example emerge respectively in the central compression chambers 16, 17.

As better shown on FIGS. 4 to 8, the first fixed scroll 4 further includes a fixed guiding portion 19 extending from the outer end portion of the spiral wrap 9, and the second fixed scroll 5 further includes a fixed guiding portion 20 extending from the outer end portion of the spiral wrap 12.

The base plate 8, the spiral wrap 9, the fixed guiding portion 19 and the base plate 13 delimit a first refrigerant inlet passage P1, while the base plate 11, the spiral wrap 12, the fixed guiding portion 20 and the base plate 13 delimit a second refrigerant inlet passage P2.

The orbiting scroll arrangement 7 further includes a first orbiting guiding portion 21 projecting from the first face of the base plate 13 and extending tangentially from the outer end portion of the first spiral wrap 14, and a second orbiting guiding portion 22 projecting from the second face of the base plate 13 and extending tangentially from the outer end portion of the second spiral wrap 15.

According to the embodiment shown on the figures, each of the first and second orbiting guiding portions 21, 22 is substantially straight, and extends in the continuity of the respective one of the first and second spiral wraps 14, 15.

The first spiral wrap 14 includes a plurality of sealing contact zones configured to cooperate with the spiral wrap 9 during the orbital movement of the orbiting scroll arrangement 7, and the second spiral wrap 15 includes a plurality of sealing contact zones configured to cooperate with the spiral wrap 12 during the orbital movement of the orbiting scroll arrangement 7. According to the embodiment shown on the figures, the first orbiting guiding portion 21 extends upstream and from the outermost sealing contact zone CZ1 provided on the first spiral wrap 14, while the second orbiting guiding portion 22 extends upstream and from the outermost sealing contact zone CZ2 provided on the second spiral wrap 15.

The first orbiting guiding portion 21 extends in the first refrigerant inlet passage P1 and is configured to guide, in use, the refrigerant supplied to the first refrigerant inlet passage P1 towards the compression chambers 16, and more particularly towards the two outermost compression chambers 16, while the second orbiting guiding portion 22 extends in the second refrigerant inlet passage P2 and is configured to guide, in use, the refrigerant supplied to the second refrigerant inlet passage P2 towards the compression chambers 17, and more particularly towards the two outermost compression chambers 17.

Advantageously, the first orbiting guiding portion 21 and the first spiral wrap 14 have substantially a same height, and the second orbiting guiding portion 22 and the second spiral wrap 15 have substantially a same height. Each of the first and second orbiting guiding portions 21, 22 includes a nose portion which may be rounded, tapered or sharp.

The scroll compressor 1 also includes a refrigerant suction pipe 23 for supplying the scroll compression unit 3 with refrigerant, and a refrigerant discharge pipe 24 for discharging the compressed refrigerant outside the scroll compressor 1. The refrigerant suction pipe 23 extends along a longitudinal axis A, and includes an outer end portion 23*a*, an intermediate portion 23*b* and a refrigerant supplying portion 23*c*.

The refrigerant suction pipe 23 is sealingly connected to the scroll compression unit 3. The scroll compression unit 3 may for example include a first mounting portion 24 into which the intermediate portion 23*b* of the refrigerant suction pipe 23 is sealingly mounted, and a second mounting portion 25 into which the refrigerant supplying portion 23*c* of the refrigerant suction pipe 23 is mounted.

The refrigerant suction pipe 23 is oriented towards the first and second refrigerant inlet passages P1, P2 and is configured to conduct, and more particularly to canalize, in use, at least a first part of the refrigerant suctioned in the refrigerant suction pipe 23 towards the first refrigerant inlet passage P1 and at least a second part of the refrigerant suctioned in the refrigerant suction pipe 23 towards the second refrigerant inlet passage P2.

According to the embodiment shown on the figures, the refrigerant supplying portion 23*c* is provided with a deflector 231 mounted inside the refrigerant supplying portion 23*c* and configured to deflect the first part of the refrigerant suctioned in the refrigerant suction pipe 23 towards the first refrigerant inlet passage P1 and the second part of the refrigerant suctioned in the refrigerant suction pipe 23 towards the second refrigerant inlet passage P2. The deflector 231 may for example have a triangular cross section.

According to the embodiment shown on the figures, the longitudinal axis A of the refrigerant suction pipe 23 extends substantially parallel to the extension direction of the first and second refrigerant inlet passages P1, P2. In other words, the refrigerant suction pipe 23 extends on the one hand substantially tangentially with respect to an inner wall of the outer end portion of the spiral wrap 9, and on the other hand substantially tangentially with respect to an inner wall of the outer end portion of the spiral wrap 12.

According to the embodiment shown on the figures, the refrigerant supplying portion 23*c* includes a refrigerant supplying aperture 232 having an upper section facing and emerging in the first refrigerant inlet passage P1 and a lower section facing and emerging in the second refrigerant inlet passage P2.

Figure 4:
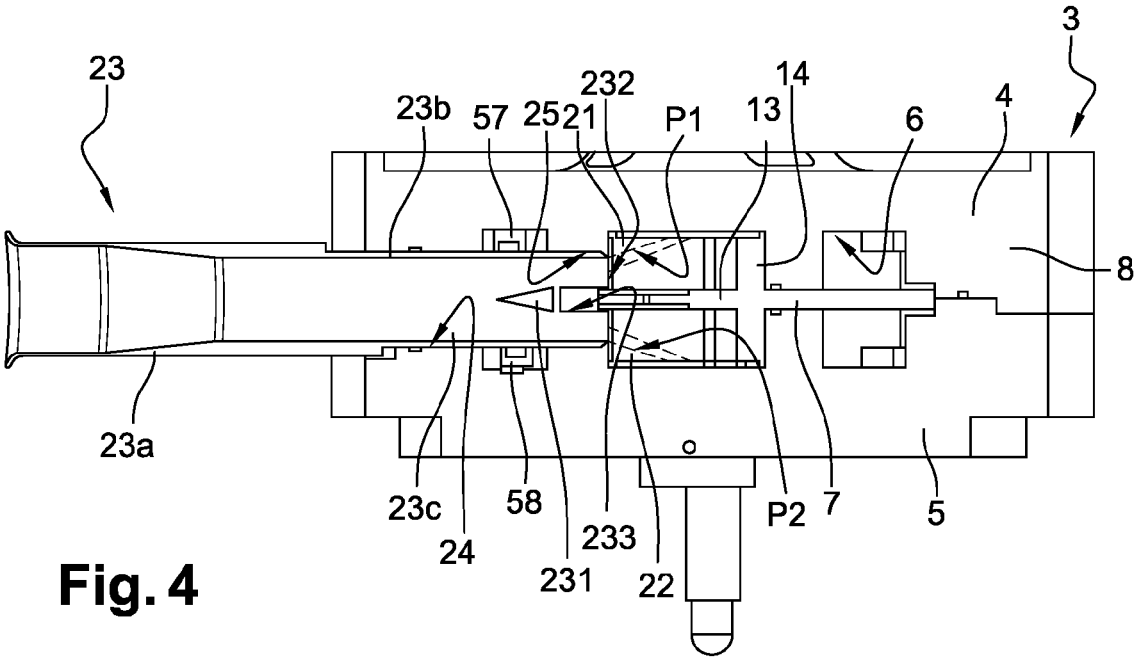
Figure 5:
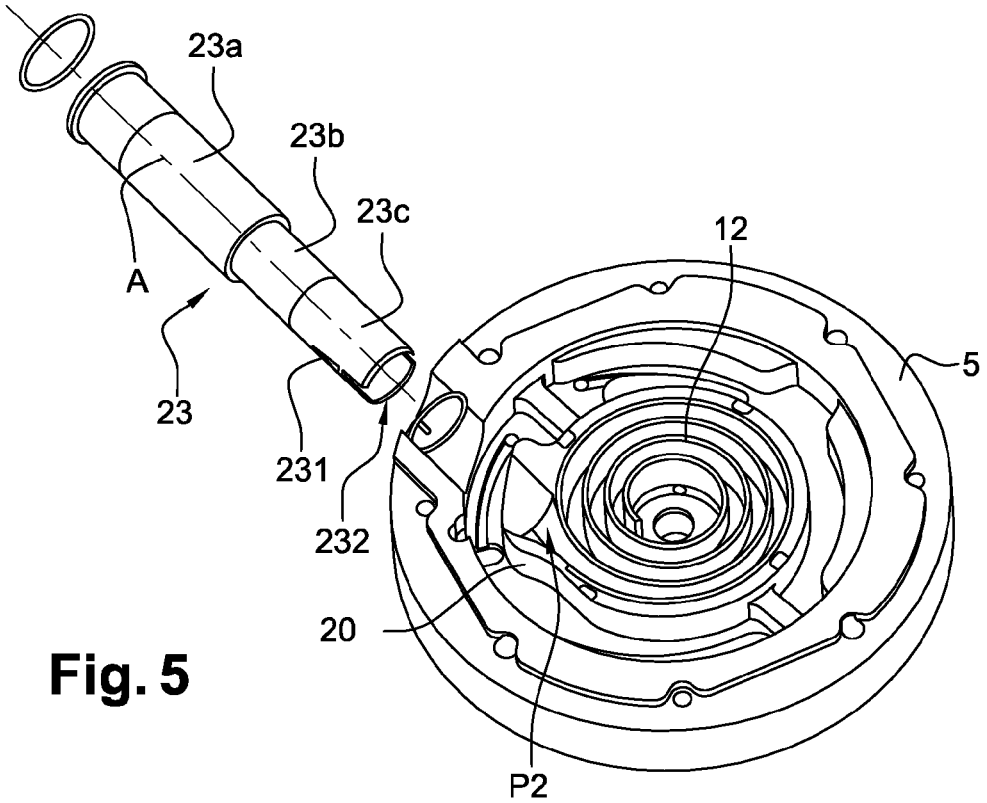
FIG. 5 is an exploded perspective view of one fixed scroll and of a refrigerant suction element of the scroll compressor of FIG. 1.
Figure 8:
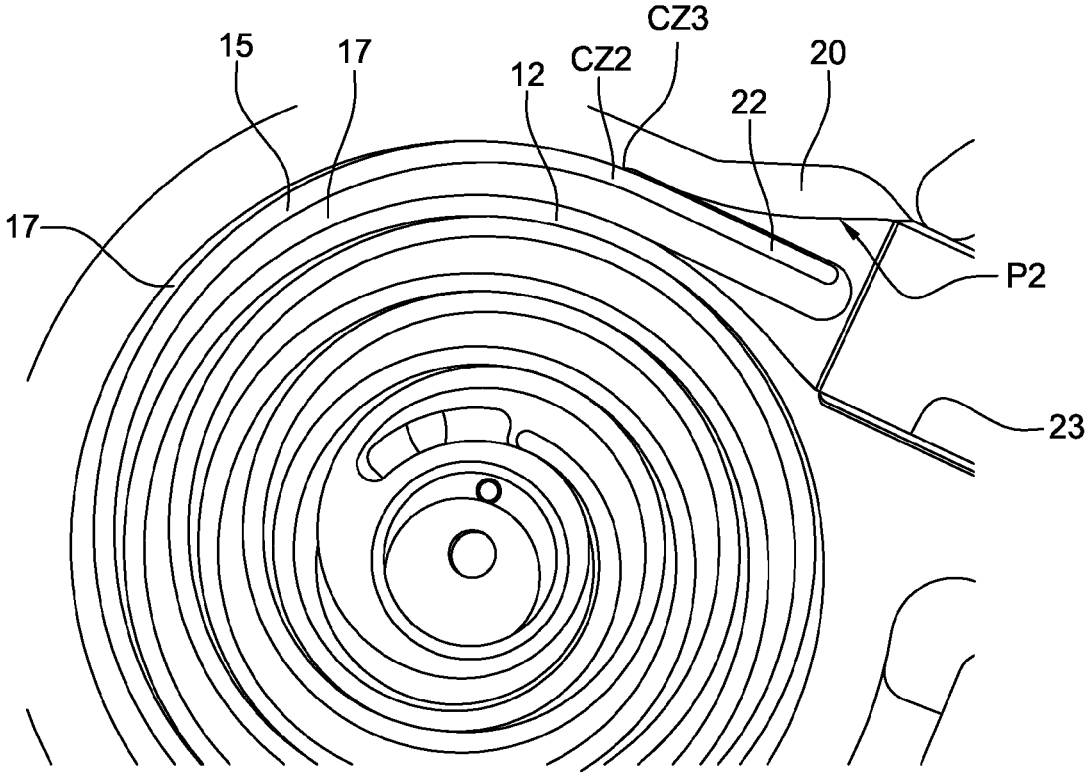
FIG. 8 is a perspective view showing an orbiting guiding portion provided on the orbiting scroll arrangement.
Figure 6:
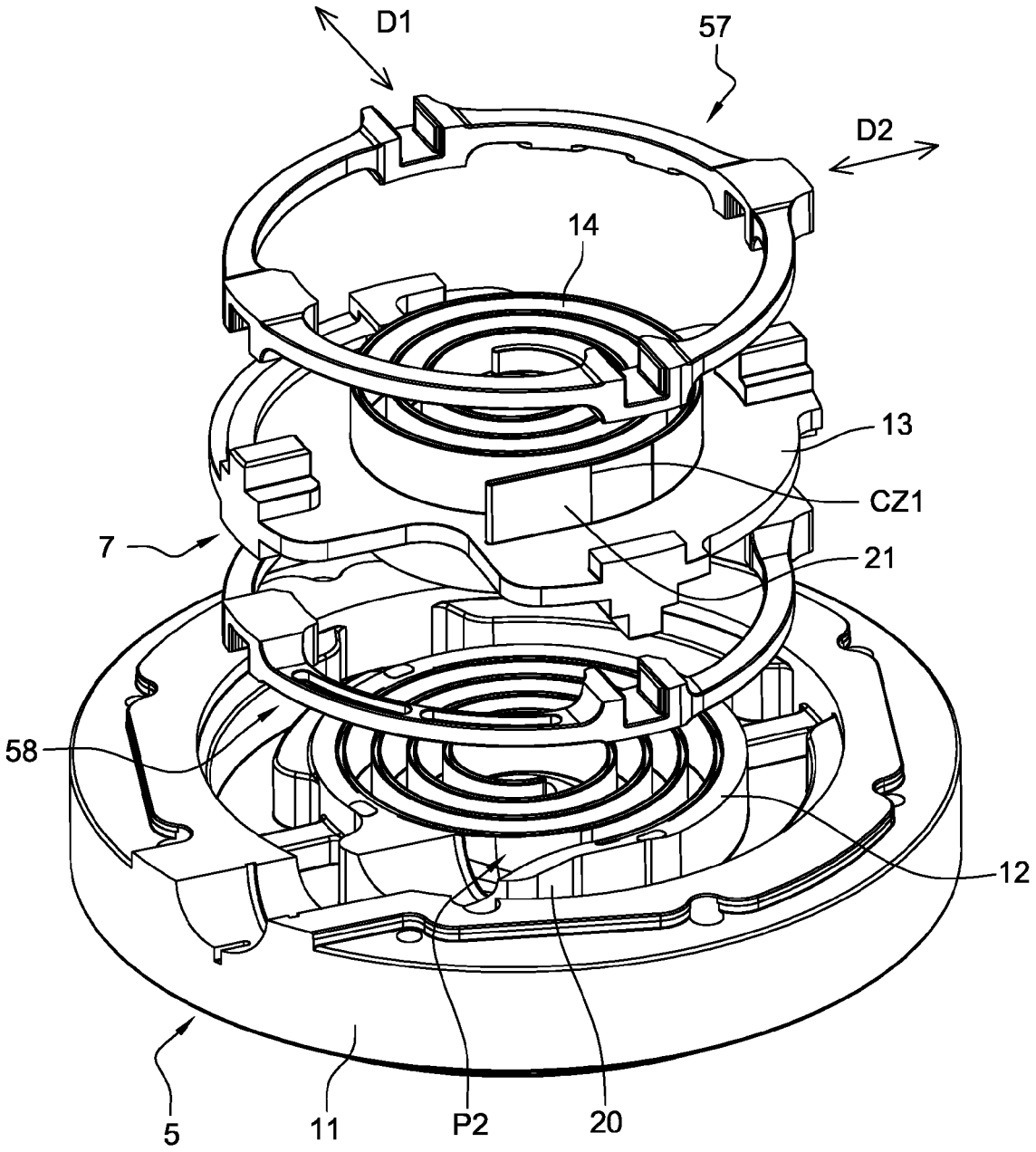
FIGS. 6 and 7 are exploded perspective views of two Oldham couplings and of an orbiting scroll arrangement of the scroll compressor of FIG. 1.
Figure 7:
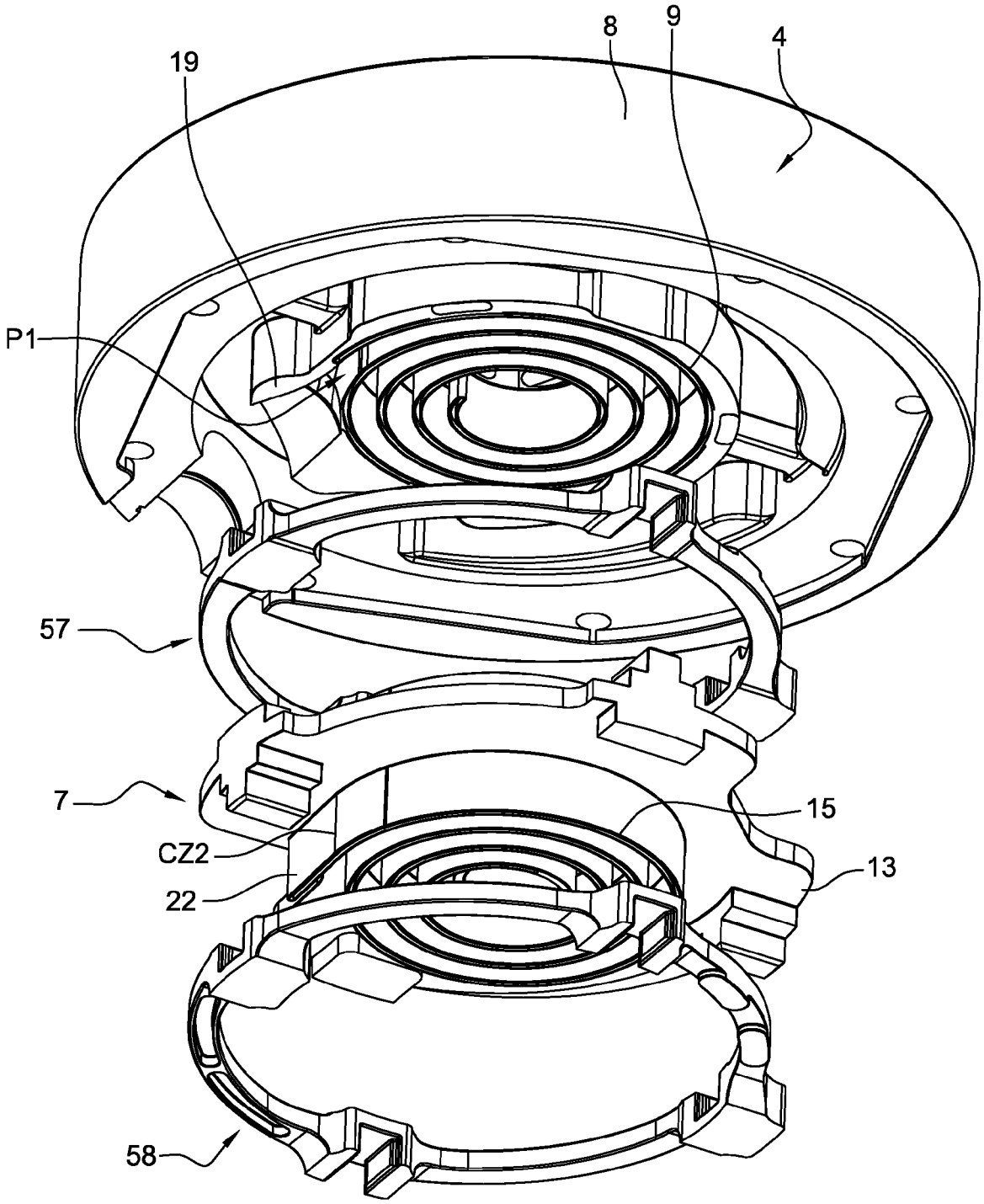

As shown on FIGS. 4, 5 and 7, the width of the first and second refrigerant inlet passages P1, P2 decreases in the refrigerant flow direction, and the height of the first and second refrigerant inlet passages P1, P2 increases in the refrigerant flow direction. Advantageously, the width of the first refrigerant inlet passage P1 decreases as far as the outermost sealing contact zone provided on the spiral wrap 9, while the width of the second refrigerant inlet passage P2 decreases as far as the outermost sealing contact zone CZ3 provided on the spiral wrap 12.

According to the embodiment shown on the figures, the refrigerant supplying portion 23*c* includes a notch 233 suitable for receiving a portion of the base plate 13 of the orbiting scroll arrangement 7 during at least a part of the orbital movement of the orbiting scroll arrangement 7. The notch 233 is advantageously located downstream the deflector 231.

According to the embodiment shown on the figures, the nose portions of the first and second orbiting guiding portions 21, 22 are oriented towards the refrigerant suction pipe 23 and are configured to be located nearby the refrigerant suction pipe 23 during at least a part of the orbital movement of the orbiting scroll arrangement 7.

The first fixed scroll 4 includes a plurality of discharge passages 26 fluidly connected to the high pressure discharge volume and arranged to conduct the refrigerant compressed in the compression chambers 16 outside the inner volume 6.

The second fixed scroll 5 also includes a plurality of discharge passage 27 fluidly connected to the high pressure discharge volume and arranged to conduct the refrigerant compressed in the compression chambers 17 outside the inner volume 6.

Furthermore the scroll compressor 1 includes a stepped drive shaft 28 adapted for driving the orbiting scroll arrangement 7 in orbital movements, an electric driving motor 29 coupled to the drive shaft 28 and arranged for driving in rotation the drive shaft 28 about a rotation axis, and an intermediate casing 30 fixed on the first fixed scroll 4 and in which the driving motor 29 is entirely mounted.

Each discharge passage 26 is provided in the base plate 8 of the first fixed scroll 4, and includes a first end portion emerging in an annular chamber C1 defined by the first fixed scroll 4 and the drive shaft 28 and fluidly connected to the central compression chamber 16, and a second end portion emerging outside the inner volume 6. Each discharge passage 27 is provided in the base plate 11 of the second fixed scroll 5, and includes a first end portion emerging in an annular chamber C2 defined by the second fixed scroll 5 and the drive shaft 28 and fluidly connected to the central compression chamber 17, and a second end portion emerging outside the inner volume 6 towards an oil sump defined by the closed container 2.

The driving motor 29, which may be a variable-speed electric motor, is located above the first fixed scroll 4. The driving motor 29 has a rotor 31 fitted on the drive shaft 28, and a stator 32 disposed around the rotor 31. The stator 32 includes a stator stack or stator core 33, and stator windings wound on the stator core 33. The stator windings define a first winding head 34*a* which is formed by the portions of the stator windings extending towards outside from the end face 33*a* of the stator core 33 oriented towards the scroll compression unit 3, and a second winding head 34*b* which is formed by the portions of the stator windings extending towards outside from the end face 33*b* of the stator core 33 opposite to the scroll compression unit 3.

As shown in FIG. 1, the intermediate casing 30 and the closed container 2 define an annular outer volume 36 fluidly connected to the discharge pipe 24. Further the intermediate casing 30 and the driving motor 29 define a proximal chamber 37 containing the first winding head 34*a* of the stator 32, and a distal chamber 38 containing the second winding head 34*b* of the stator 32.

The intermediate casing 30 is provided with a plurality of refrigerant discharge apertures 39 emerging in the distal chamber 38 and arranged to fluidly connect the distal chamber 38 and the annular outer volume 36. According to the embodiment shown on the figures, the intermediate casing 30 includes a side part 30*a* surrounding the stator 32 and a closing part 30*b* closing an end portion of the side part 30*a* opposite to the first fixed scroll 4.

According to the embodiment shown on the figures, the second end portion of each discharge passages 26 emerges in the proximal chamber 37 nearby the driving motor 29, and particularly nearby the first winding head 34*a* of the stator 32. Advantageously, each of the discharge passages 26, 27 is inclined relative to the rotation axis of the drive shaft 28.

The drive shaft 28 extends vertically across the base plate 13 of the orbiting scroll arrangement 7. The drive shaft 28 comprises a first end portion 40 located above the first fixed scroll 4 and on which is fitted the rotor 31, and a second end portion 41 opposite to the first end portion 40 and located below the second fixed scroll 5. The first end portion 40 has an external diameter larger than the external diameter of the second end portion 41. The first end portion 40 includes a central recess 42 emerging in the end face of the drive shaft 28 opposite to the second end portion 41.

The drive shaft 28 further comprises a first guided portion 43 and a second guided portion 44 located between the first and second end portion 40, 41, and an eccentric driving portion 45 located between the first and second guided portions 43, 44 and being off-centered from the center axis of the drive shaft 28. The eccentric driving portion 45 is arranged to cooperate with the orbiting scroll arrangement 7 so as to cause the latter to be driven in an orbital movement relative to the first and second fixed scrolls 4, 5 when the driving motor 29 is operated.

The scroll compressor 1 further comprises guide bearings 46, 47 provided on the first and second fixed scrolls 4, 5 and arranged for guiding in rotation the first and second guided portions 43, 44 of the drive shaft 28. The scroll compressor 1 further comprises one or two bearings 48 provided on the orbiting scroll arrangement 7 and arranged for cooperating with the eccentric driving portion 45 of the drive shaft 28.

The drive shaft 28 further comprises a first and a second lubrication channels 49, 50 extending over a part of the length of the drive shaft 28 and arranged to be supplied with oil from the oil sump defined by the closed container 2, by an oil pump 51 driven by the second end portion 41 of the drive shaft 28.

The drive shaft 28 also comprises lubrication holes 52, 53 fluidly connected to the first lubrication channel 49 and respectively opening into an outer wall of the first guided portion 43 and an outer wall of the eccentric driving portion 45. According to the embodiment shown on the figures, each lubrication hole 52 faces a respective guide bearing 46, and each lubrication hole 53 faces a respective bearing 48. The drive shaft 28 further comprises at least one lubrication hole 54 fluidly connected to the second lubrication channel 50 and opening into an outer wall of the second guided portion 44 of the drive shaft 28 facing the guide bearing 47.

The drive shaft 28 may further comprise a vent hole 55 fluidly connected on the one hand to the first lubrication channel 49 and on the other hand to the central recess 42 of the first end portion 40 of the drive shaft 28.

The drive shaft 28 may further comprise a communicating channel 56 arranged to fluidly connect the first and second lubrication channels 49, 50. The communicating channel 56 ensures the degassing of the oil circulating in the second lubrication channel 50, and the flow of the refrigerant originating from the degassing into the first lubrication channel 49 towards the vent hole 55.

The scroll compressor 1 also comprises a first Oldham coupling 57 which is slidably mounted with respect to the first fixed scroll 4 along a first displacement direction D1, and a second Oldham coupling 58 which is slidably mounted with respect to the second fixed scroll 5 along a second displacement direction D2 which is substantially orthogonal to the first displacement direction D1. The first and second displacement directions D1, D2 are substantially perpendicular to the rotation axis of the drive shaft 28. The first and second Oldham couplings 57, 58 are configured to prevent rotation of the orbiting scroll arrangement 7 with respect to the first and second fixed scrolls 4, 5. Each of the first and second Oldham couplings 57, 58 undergoes a reciprocating motion respectively along the first and second displacement directions D1, D2.

The first and second Oldham couplings 57, 58 are located in the inner volume 6 and extend respectively above and below the refrigerant suction pipe 23.

The scroll compressor 1 further includes a first counterweight 59 and a second counterweight 60 connected to the drive shaft 28, and arranged to balance the mass of the orbiting scroll arrangement 7. The first counterweight 59 is located above the first fixed scroll 4, and the second counterweight 60 is located below the second fixed scroll 5.

In operation, a first part of the refrigerant supplied by the refrigerant suction pipe 23 enters the first refrigerant inlet passage P1 and is guided towards the outermost compression chambers 16 by the first orbiting guiding portion 21, then is compressed into the compression chambers 16 and escapes from the centre of the first fixed scroll 4 and of the orbiting scroll arrangement 7 through the discharge passages 26 leading to the proximal chamber 37. The compressed refrigerant entering in the proximal chamber 37 then flows upwardly towards the distal chamber 38 by passing through refrigerant flow passages delimited by the stator 32 and the intermediate casing 30 and through gaps delimited between the stator 32 and the rotor 31. Next, the compressed refrigerant travels through the refrigerant discharge apertures 39 leading to the annular outer volume 36, from which the compressed refrigerant is discharged by the discharge pipe 24.

Thus the compressed refrigerant coming out of the discharge passages 26 cools down the first winding head 34*a*, the compressed refrigerant passing through the refrigerant flow passages cools down the stator core 33, the refrigerant passing through the gaps cools down the stator core 33, the stator windings and the rotor 31, while the compressed refrigerant coming out of the refrigerant flow passages and of the gaps cools down the second winding head 34*b*. Such a cooling down of the driving motor 29 protects the stator 32 and the rotor 31 against damage (by limiting the temperature by forced convection) and improves the efficiency of the scroll compressor 1.

In operation, a second part of the refrigerant supplied by the refrigerant suction pipe 23 enters the second refrigerant inlet passage P2 and is guided towards the outermost compression chambers 17 by the second orbiting guiding portion 22, then is compressed into the compression chambers 17 and escapes from the centre of the second fixed scroll 5 and of the orbiting scroll arrangement 7 partially through the communicating hole 18 and the discharge passages 26, and partially through the discharge passages 27 leading to the high pressure discharge volume. Therefore, a first part of the refrigerant compressed in the compression chambers 17 is discharged by the refrigerant discharge pipe 24 without cooling down the driving motor 29, and a second part of the refrigerant compressed in the compression chambers 17 is discharged by the refrigerant discharge pipe 24 after having cooling down the driving motor 29.

The configuration of the discharge passages 26, 27 allows to balance the pressure in the oil sump on the one hand, and the pressure in the space in which emerges the refrigerant discharge pipe 24 on the other hand. Such a pressure balance avoids the "oil cleaning" of the several bearings by the refrigerant.

Further, the configuration of the refrigerant suction pipe 23, of the first and second orbiting guiding portion 21, 22 and of the fixed guiding portions 19, 20 induces a reduction of the pressure drops upstream the outermost compression chambers, and an improvement of the filling of the outermost compression chambers, which lead to an increase of efficiency of the scroll compression unit, and thus of the scroll compressor.

Of course, the invention is not restricted to the embodiment described above by way of non-limiting example, but on the contrary it encompasses all embodiments thereof.

While the present disclosure has been illustrated and described with respect to a particular embodiment thereof, it should be appreciated by those of ordinary skill in the art that various modifications to this disclosure may be made without departing from the spirit and scope of the present disclosure.

What is claimed is:

1. A scroll compressor including:

a scroll compression unit including at least:

a first fixed scroll including a first fixed base plate and a first fixed spiral wrap, an orbiting scroll arrangement including a first orbiting spiral wrap, the first fixed spiral wrap and the first orbiting spiral wrap forming a plurality of first compression chambers, the first orbiting spiral wrap including a plurality of sealing contact zones configured to cooperate with the first fixed spiral wrap during an orbital movement of the orbiting scroll arrangement, a refrigerant suction part configured to supply the scroll compression unit with refrigerant to be compressed, wherein the orbiting scroll arrangement further includes a first orbiting guiding portion extending from an outer end portion of the first orbiting spiral wrap and configured to guide, in use, at least a part of the refrigerant supplied to the scroll compression unit towards the first compression chambers, the first orbiting guiding portion being arranged upstream an outermost sealing contact zone belonging to said sealing contact zones with respect to a refrigerant flow direction, wherein the first orbiting guiding portion has a first end and a second end, the first end being attached to the outer end portion of the first orbiting spiral wrap, wherein the second end of the first orbiting guiding portion is arranged upstream of the first end of the first orbiting guiding portion; and wherein the first orbiting guiding portion extends tangentially with respect to the outer end portion of the first orbiting spiral wrap.

2. The scroll compressor according to claim 1, wherein the first orbiting guiding portion extends from said outermost sealing contact zone.

3. The scroll compressor according to claim 2, wherein the first fixed scroll further includes a first fixed guiding portion extending from an outer end portion of the first fixed spiral wrap, the first fixed guiding portion partially delimiting a first refrigerant inlet passage in which extends the first orbiting guiding portion.

4. The scroll compressor according to claim 2, wherein the first orbiting guiding portion is straight.

5. The scroll compressor according to claim 1, wherein the first fixed scroll further includes a first fixed guiding portion extending from an outer end portion of the first fixed spiral wrap, the first fixed guiding portion partially delimiting a first refrigerant inlet passage in which extends the first orbiting guiding portion.

6. The scroll compressor according to claim 5, wherein the first orbiting guiding portion is straight.

7. The scroll compressor according to claim 5, wherein the width of the first refrigerant inlet passage decreases in a refrigerant flow direction.

8. The scroll compressor according to claim 7, wherein the first orbiting guiding portion is straight.

9. The scroll compressor according to claim 1, wherein the first orbiting guiding portion is straight.

10. The scroll compressor according to claim 1, wherein the first orbiting guiding portion includes a nose portion oriented towards the refrigerant suction part.

11. The scroll compressor according to claim 10, wherein the nose portion of the first orbiting guiding portion is configured to be located nearby the refrigerant suction part during at least a part of the orbital movement of the orbiting scroll arrangement.

12. The scroll compressor according to claim 1, wherein the refrigerant suction part is formed by a refrigerant suction element sealingly connected to the scroll compression unit.

13. The scroll compressor according to claim 12, wherein the refrigerant suction element includes a notch configured to receive a portion of an orbiting base plate of the orbiting scroll arrangement during at least a part of the orbital movement of the orbiting scroll arrangement.

14. The scroll compressor according to claim 1, wherein the refrigerant suction part is provided with a deflector member configured to deflect at least a first part of the refrigerant suctioned in the refrigerant suction part towards the first compression chambers.

15. An orbiting scroll arrangement for a scroll compressor, the orbiting scroll arrangement including:

a first orbiting spiral wrap designed to partially form a plurality of first compression chambers, the first orbiting spiral wrap including a plurality of sealing contact zones, and a first orbiting guiding portion extending from an outer end portion of the first orbiting spiral wrap and configured to guide, in use, refrigerant towards the first compression chambers, the first orbiting guiding portion being located upstream an outermost sealing contact zone belonging to said sealing contact zones with respect to a refrigerant flow direction, wherein the first orbiting guiding portion has a first end and a second end, the first end being attached to the outer end portion of the first orbiting spiral wrap, wherein the second end of the first orbiting guiding portion is arranged upstream of the first end of the first orbiting guiding portion, and wherein the first orbiting guiding portion extends tangentially with respect to the outer end portion of the first orbiting spiral wrap.

16. A scroll compressor including:

a scroll compression unit including at least:

a first fixed scroll including a first fixed base plate and a first fixed spiral wrap, an orbiting scroll arrangement including a first orbiting spiral wrap, the first fixed spiral wrap and the first orbiting spiral wrap forming a plurality of first compression chambers, the first orbiting spiral wrap including a plurality of sealing contact zones configured to cooperate with the first fixed spiral wrap during an orbital movement of the orbiting scroll arrangement, a refrigerant suction part configured to supply the scroll compression unit with refrigerant to be compressed, wherein the orbiting scroll arrangement further includes a first orbiting guiding portion extending from an outer end portion of the first orbiting spiral wrap and configured to guide, in use, at least a part of the refrigerant supplied to the scroll compression unit towards the first compression chambers, the first orbiting guiding portion being arranged upstream an outermost sealing contact zone belonging to said sealing contact zones with respect to a refrigerant flow direction, wherein the first orbiting guiding portion has a first end and a second end, the first end being attached to the outer end portion of the first orbiting spiral wrap, wherein the second end of the first orbiting guiding portion is arranged upstream of the first end of the first orbiting guiding portion; and wherein the first fixed scroll further includes a first fixed guiding portion extending from an outer end portion of the first fixed spiral wrap, the first fixed guiding portion partially delimiting a first refrigerant inlet passage in which extends the first orbiting guiding portion.

17. The scroll compressor according to claim 16, wherein the width of the first refrigerant inlet passage decreases in a refrigerant flow direction.

18. The scroll compressor according to claim 16, wherein the first orbiting guiding portion is straight.

19. The scroll compressor according to claim 16, wherein the first orbiting guiding portion includes a nose portion oriented towards the refrigerant suction part.

20. The scroll compressor according to claim 16, wherein the refrigerant suction part is formed by a refrigerant suction element sealingly connected to the scroll compression unit.

21. The scroll compressor according to claim 16, wherein the refrigerant suction part is provided with a deflector member configured to deflect at least a first part of the refrigerant suctioned in the refrigerant suction part towards the first compression chambers.

* * * * *